United States Patent [19]

von Obstfelder

[11] 4,371,140

[45] Feb. 1, 1983

[54] BUOYANT SOAP HOLDER

[76] Inventor: Nikalous von Obstfelder, 9 Langton Rd., Tunbridge Wells, Kent, England

[21] Appl. No.: 222,211

[22] Filed: Jan. 2, 1981

[51] Int. Cl.[3] ..... A47B 91/00

[52] U.S. Cl. ..... 248/359; D6/89; 248/309 R

[58] Field of Search ..... 248/309 R, 359, 360; D6/89; D28/8.1

[56] References Cited

U.S. PATENT DOCUMENTS

| | | | |
|---|---|---|---|
| D. 149,066 | 3/1948 | Kaplan | D6/89 |
| 702,531 | 6/1902 | Bowen | 248/359 |
| 2,192,557 | 3/1940 | Netz | 248/216.1 X |
| 2,851,713 | 9/1958 | Tupper | D6/89 |
| 3,108,392 | 10/1963 | Sams | 248/359 |
| 3,405,479 | 10/1968 | Paulson | 46/26 X |
| 3,608,853 | 9/1971 | Sertich | 248/309 |
| 3,890,738 | 6/1975 | Bassani | 46/26 X |
| 4,214,402 | 7/1980 | Ogawa | 46/1 E X |

FOREIGN PATENT DOCUMENTS

| | | | |
|---|---|---|---|
| 670544 | 4/1952 | United Kingdom | 248/359 |

*Primary Examiner*—J. Franklin Foss

*Attorney, Agent, or Firm*—McGlew and Tuttle

[57] ABSTRACT

A buoyant soap support has a domed upper wall fixed to a lower wall formed with a central projection and ring of teeth for biting into and retaining a bar of soap.

4 Claims, 13 Drawing Figures

BUOYANT SOAP HOLDER

Figure 1:
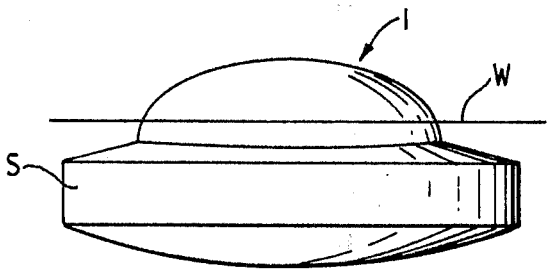

This invention relates to a soap support comprising a body within which is defined an air chamber of sufficient volume to render buoyant a bar of soap.

A problem which arises, particularly when bathing small children, is that a bar of soap may be dropped into the bath water and disappear from view. British patent specification No. 1 041 667 proposes that a bar of soap should be attached to a waisted handle to make the soap easier to handle. The handle may be hollow so that it provides the soap with sufficient buoyancy to keep the soap afloat in the event that it is dropped into water. However, the handle is of relatively complex shape which makes it difficult to manufacture and to use when bathing. Buoyant soap supports are also known from British patent specifications Nos. 256 512 and 692 189 which are intended to support soap while floating in the bath but from which the soap must be removed in order for it to be used. These soap supports, therefore, do not solve the problem of providing a soap support which is convenient to use and which will prevent the disappearance of the soap into the bath water.

The present invention therefore has for its object the provision of a soap support which may be permanently attached to a bar of soap in order to render it buoyant and which is of such a design that it does not interfere with the use of the soap in the normal way during bathing.

Accordingly, a buoyant soap support is characterised by a lower wall shaped to conform to the surface of the bar of soap, teeth or other formations projecting from the lower wall and a generally domed upper wall defining with the lower wall the air chamber.

Figure 2:
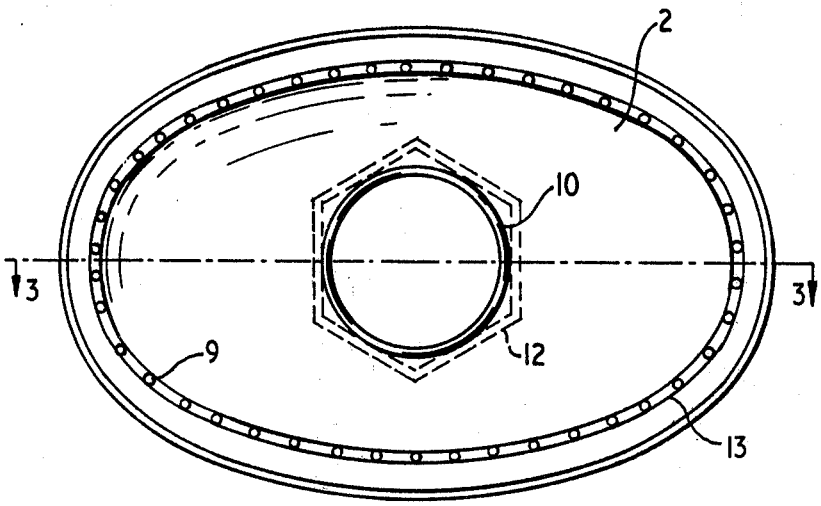
Figure 3:
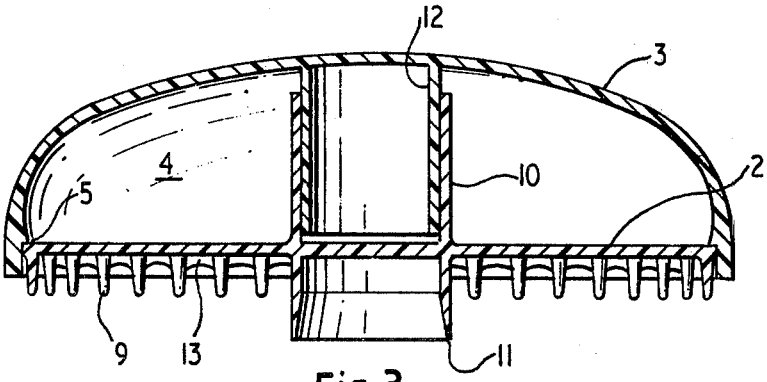
Figure 3A:
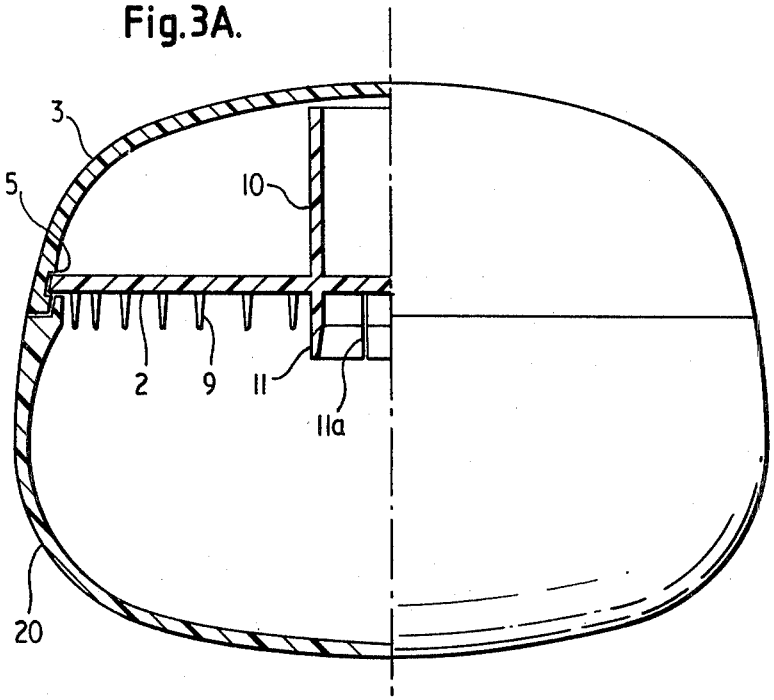
Figure 3B:
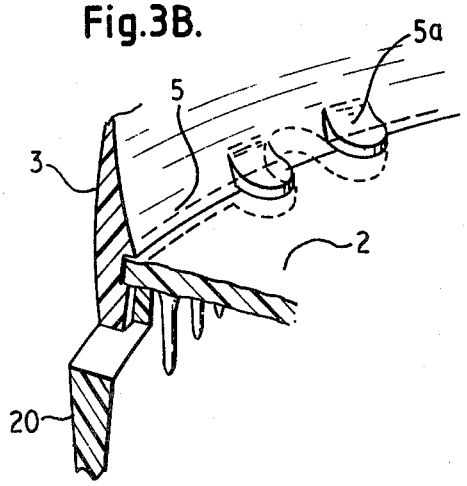
Figure 4:
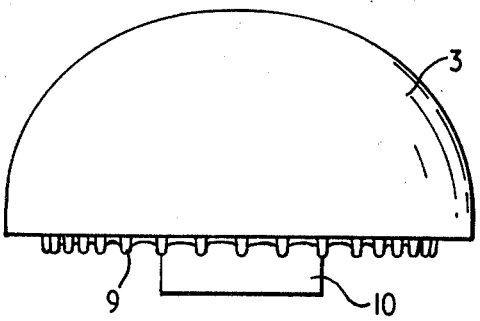
Figure 5:
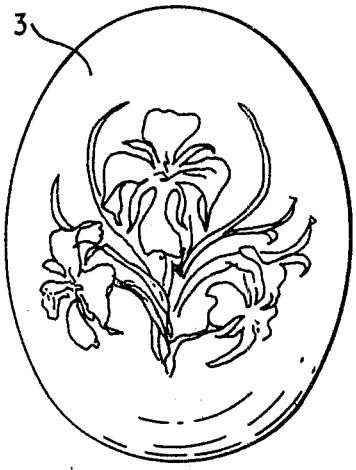
Figure 6:
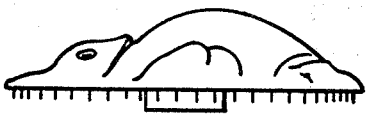
Figure 7:
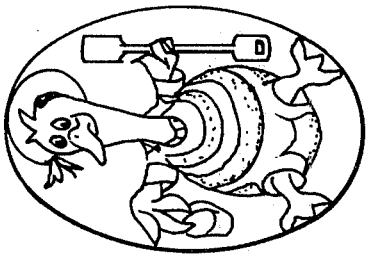
Figure 8:
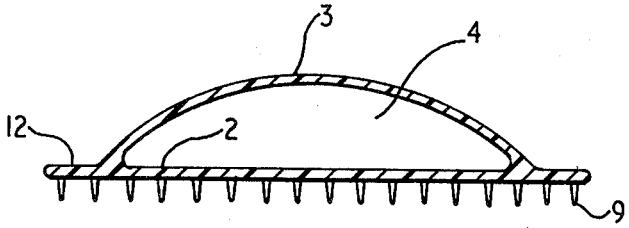
Figure 9:
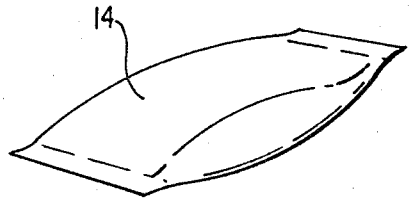
Figure 10:
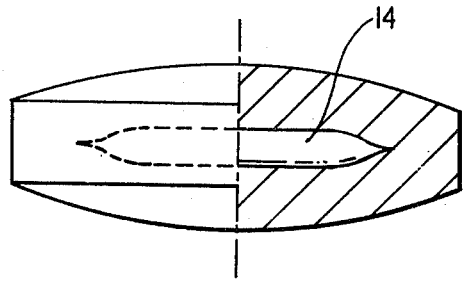
Figure 11:
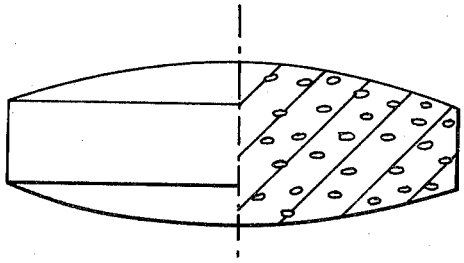

In the drawings:

FIG. 1 is a side view showing one embodiment of the soap support attached to a bar of soap, FIG. 2 is an underneath plan view of the soap support shown in FIG. 1, FIG. 3 is a section on the line III—III in FIG. 2, FIG. 3A is a section similar to FIG. 3 but through a modified construction, FIG. 3B is perspective detail of FIG. 3A, FIG. 4 is an end elevation of the soap support shown in FIG. 1, FIG. 5 is a top plan view of the soap support shown in FIG. 1, FIG. 6 is side view of a modified soap support, FIG. 7 is a top plan view of the soap support shown in FIG. 6, FIG. 8 is a section similar to FIG. 3 through a second embodiment, FIG. 9 is a perspective view of an air sachet, FIG. 10 shows the air sachet moulded into a bar of soap, and FIG. 11 is a part section through an inherently buoyant bar of soap.

Referring to FIGS. 1 to 5, a bar of soap S may be kept afloat when dropped into the bath water by a support formed from rigid plastics and indicated at 1. The support has a bottom part comprising a generally planar lower wall 2 surmounted by a top part comprising a dome-shaped upper wall 3. A buoyancy chamber 4 is defined between the two walls and is of sufficient volume to provide the desired amount of uplift. The lower wall is moulded separately from the upper wall and is fitted into a groove 5 in the rim of the upper wall. Coupling means coupling the lower wall 2 to the upper wall 3 includes an integral spigot 10 of hexagonal cross-section projecting from the inner side of the lower wall receives tightly a cylindrical spigot 12 projecting from the inner side of the upper wall to hold the two parts together. If desired, two parts may be welded together. In the vicinity of its edge, the lower wall has a row of downwardly projecting teeth, spikes or other formations 9 interconnected by webs 13 so as to form a continuous wall capable of becoming embedded into the soap. At its centre, the underside of the lower wall has an integral tubular projection 11 with a sharp edge adapted to bury itself in the soap.

With the support 1 attached to the soap by the combined effect of the projection 10 and spikes 9 and webs 13, the soap is prevented from sinking and floats slightly below the surface of the water W with the support above it. A degree of suction is produced between the soap and the interior of the projection 11 and the space formed within the wall constituted by the spikes 9 and webs 13 and tends to hold the support to the soap.

As shown in FIG. 5, the upper surface of the support may be printed or embossed with a design. Alternatively, the upper wall of the support may be moulded to a particular shape, for example, that of a flower or that of the face or body of an animal or a cartoon character as depicted in FIGS. 6 and 7. The generally domed shape of the support allows it to fit easily within the hand even when shaped in this way. Instead of being planar, the underside of the soap support may be dished so as to conform to the shapes of certain soaps. Likewise, instead of being oval, the holder may be circular, square or of some other shape. In the modification shown in FIGS. 3A and 3B, groove 5 is underct, projection 11 is split at circumferentially spaced locations, 11*a* and spigot 12 is omitted. Lugs 5*a* at spaced intervals around the periphery of the upper wall help locate the lower wall. As shown in FIG. 3A, a soap box 20 may be provided to support this, or any other construction of soap support disclosed herein and to house soap attached to it. The wall of the soap box is rebated to interfit with a projecting portion of the upper wall as shown. The support may have a length of about 5.75 cm, a width of 3.75 cm, and a maximum thickness of 1.75 cm. The teeth may be 0.3 cm in length, and the tubular projection 1.25 cm. in length. As shown in FIG. 8, the buoyancy chamber 4 may be completely closed, by forming the upper and lower walls integral with each other, and teeth 9 provided on a rim portion 12 of lower wall 2 projecting beyond the upper wall, there being no central projection. Alternatively, the teeth may be omitted altogether and the rim turned down so that it bites into the soap. In a modification, not illustrated, the lower wall 2 is reduced to a narrow peripheral portion including the rim 12 and the interior of the domed wall 3 is entirely open to the underside of the support, such a modification relying upon the bar of soap to cooperate to form the buoyancy chamber.

It will be appreciated that it falls within the scope of the invention for there to be two or more separate buoyancy chambers and for the support to be incorporated into a bar of novelty soap during manufacture of the latter. It is also possible as shown in FIG. 10 for a bar of soap to be moulded on a plane, hollow plastics bulb such as the sachet 14 shown in FIG. 9 which is formed by sealing a tube of film so as to form a buoyancy chamber within the soap, but which is obscured from view. In a modification of this embodiment, shown in FIG. 11, the bar of soap is formed with a plurality of air bubbles to provide the desired amount of buoyancy.

The soap support of the present invention is not intended to float continuously when in use but only when the soap is allowed to fall into the water when bathing. In the floating condition, the support of the present invention floats with the soap beneath it. As the upper wall of the present support may therefore have printed or embossed thereon a design which is plainly visible when the support is floating. The invention is, therefore, especially adapted to display advertising material.

I claim:

1. A buoyant support for a bar of soap, comprising a generally dome shaped upper wall member having an internal projecting spigot, a separate lower wall member having an internal projecting lower wall spigot and being engaged with said upper wall member with said spigot interfitting with said lower wall spigot and defining an air chamber between said upper wall member and said lower wall member with sufficient volume to render buoyant a bar of soap, said lower wall member being shaped to conform to the surface of the bar of soap and having teeth-like formations projecting from said lower wall member engageable into the bar of soap, said lower wall member including an integral hollow projection capable of being embedded in the soap, said teeth-like formations being arranged in a row adjacent the edge of said lower wall member and encircling said hollow projection, said upper wall member being shaped to represent an object, said upper wall member having a peripheral wall, and a box having a peripheral wall adapted to support and interlock with said peripheral wall of said upper wall portion and to accommodate a bar of soap.

2. A buoyant support for a bar of soap, comprising a float including an upper portion of dome shaped configuration having an annular rim enclosing a hollow bottom and a lower portion enclosing said hollow bottom and engaged peripherally with said rim of said upper portion and defining a closed hollow space of sufficient volume to support the bar of soap for floating together, said bottom member including a bottom surface with projection means thereon engageable into a bar of soap for securing the bar of soap thereto wherein said projection means includes a plurality of teeth arranged in a row around the periphery of said bottom portion, said bottom portion being separate from said upper portion and including coupling means defined between said upper and lower portions interconnecting said upper and lower portions together.

3. A buoyant support according to claim 2, wherein said coupling means comprises a tubular spigot centrally and internally located in said upper portion and a lower spigot defined on the interior wall of said lower portion engaged with said spigot.

4. A buoyant support according to claim 1, wherein said coupling means comprises a plurality of lugs carried by said upper portion engageable over said lower portion, said upper portion having a recessed groove defined therein into which the periphery of said lower portion engages and below said lugs.

* * * * *